US011401747B2

(12) United States Patent
Romero

(10) Patent No.: US 11,401,747 B2
(45) Date of Patent: Aug. 2, 2022

(54) MOTOR ASSISTED REVOLVING DOOR SYSTEM AND METHOD WITH MULTIPLE SENSORS

(71) Applicant: Overhead Door Corporation, Lewisville, TX (US)

(72) Inventor: Federico Romero, Corpus Christi, TX (US)

(73) Assignee: Overhead Door Corporation, Lewisville, TX (US)

( * ) Notice: Subject to any disclaimer, the term of this patent is extended or adjusted under 35 U.S.C. 154(b) by 203 days.

(21) Appl. No.: 16/807,929

(22) Filed: Mar. 3, 2020

(65) Prior Publication Data

US 2021/0277704 A1 Sep. 9, 2021

(51) Int. Cl.

| | |
|---|---|
| ***E05F 15/608*** | (2015.01) |
| ***E05F 15/75*** | (2015.01) |
| ***E06B 3/90*** | (2006.01) |

(52) U.S. Cl.

CPC ..... *E05F 15/608* (2015.01); *E05F 15/75* (2015.01); *E06B 3/90* (2013.01); *E06B 3/903* (2013.01)

(58) Field of Classification Search

CPC ..... E05F 15/608; E05F 15/73; E05F 15/75; E06B 3/90; E06B 3/903

USPC ..... 49/42–47

See application file for complete search history.

(56) References Cited

U.S. PATENT DOCUMENTS

| | | | | | |
|---|---|---|---|---|---|
| 4,475,308 | A * | 10/1984 | Heise | E05F 15/44 | 49/42 |
| 4,530,183 | A * | 7/1985 | Heise | E05F 15/44 | 109/8 |
| 4,534,131 | A * | 8/1985 | Blackston | E05D 15/02 | 109/8 |
| 4,586,441 | A | 5/1986 | Zekich | | |
| 4,628,496 | A * | 12/1986 | Lee | G01S 15/04 | 367/93 |
| 4,785,580 | A * | 11/1988 | Olesen | E05D 15/02 | 49/44 |
| RE33,407 | E | 10/1990 | Schwarz | | |
| 5,097,454 | A * | 3/1992 | Schwarz | G01S 15/87 | 367/93 |
| 5,647,173 | A * | 7/1997 | Stark | F16P 3/00 | 49/43 |
| 5,697,867 | A | 12/1997 | Diaz-Lopez | | |
| 5,878,529 | A | 3/1999 | Huber | | |
| 6,058,652 | A * | 5/2000 | Uhl | E06B 3/90 | 49/138 |
| 6,742,301 | B1 | 6/2004 | Schwarz | | |
| 8,015,754 | B2 | 9/2011 | Slagel | | |

(Continued)

*Primary Examiner* — Justin B Rephann

(74) *Attorney, Agent, or Firm* — Haynes and Boone, LLP

(57) ABSTRACT

A control system for a door includes: a controller; a door motor configured to be operatively connected to the controller; an object sensor configured to be operatively connected to the controller and to detect a presence of an object; and an operation sensor configured to be operatively connected to the controller and to detect movement of a door, and wherein the controller is configured to send a operation signal to the door motor to cause the door motor to operate when the controller detects both: a signal from the object sensor indicating that the operation sensor has detected the presence of and object; and a signal from the operation sensor indicating that the operation sensor has detected movement.

20 Claims, 2 Drawing Sheets

(56) References Cited

U.S. PATENT DOCUMENTS

| | | | | |
|---|---|---|---|---|
| 8,171,864 | B2 | 5/2012 | Mucio | |
| 8,819,855 | B2 | 8/2014 | Prasad | |
| 8,832,997 | B2 | 9/2014 | Osann, Jr. | |
| 10,021,350 | B2 | 7/2018 | Rayner | |
| 11,053,729 | B2 | 7/2021 | Romero et al. | |
| 2005/0045078 | A1* | 3/2005 | Chen | E05G 5/02 109/8 |
| 2008/0028682 | A1* | 2/2008 | Casella | E05F 15/608 49/25 |
| 2008/0110093 | A1* | 5/2008 | Liles | E05F 15/73 49/42 |
| 2008/0244978 | A1* | 10/2008 | Soyugenc | E05F 15/608 49/42 |
| 2010/0011665 | A1* | 1/2010 | Osann, Jr. | E05G 5/003 49/31 |
| 2012/0090239 | A1* | 4/2012 | Hondius | E06B 3/90 49/27 |
| 2013/0298466 | A1* | 11/2013 | Osann, Jr. | E05D 15/58 49/28 |

* cited by examiner

MOTOR ASSISTED REVOLVING DOOR SYSTEM AND METHOD WITH MULTIPLE SENSORS

TECHNICAL FIELD

This patent disclosure relates generally to doors and, more particularly, to revolving doors.

BACKGROUND

Revolving door systems are used to allow people to enter and exit buildings. The revolving door used in various systems may be of differing sizes to accommodate the size and capacity needs of a particular installation. Large revolving doors may be heavy and more difficult to manually operate then smaller doors. In some instances, revolving doors may be equipped with an operator (for example a motor) and the door system configured so that when the door is pushed, the operator provides force to assist the rotation of the door. Such doors may require minimal force to be applied on the door by the person to operate the door. Other door systems may detect a push on the door (presumably by a person attempting to move through the door system) and initiate a rotation of the door.

In either case, some door systems may actuate the door operator to impart a rotational force on the door when no one is attempting to move through the door system. For example, wind may pressure may exert enough rotational force on a door to cause the door system to actuate the operator to impart a rotational force on the door. This causes unnecessary wear on the door system, and wastes energy by both loss of headed or cooled air from inside the building where the door system is located and consuming energy to actuate the door operator when no one was trying to move through the door system.

In view of the inefficiencies of some door systems discussed above, it may be desirable to have a door system that has a reduced likelihood of actuating the operator when no one is attempting to move through the door system.

SUMMARY

The foregoing needs are met to a great extent by embodiments in accordance with the present disclosure, wherein, in some embodiments, describes a door system that has a reduced likelihood of actuating the operator when no one is attempting to move through the door system.

In one aspect, the disclosure describes a control system for a door. The control system includes: a controller; a door motor configured to be operatively connected to the controller; an object sensor configured to be operatively connected to the controller and to detect a presence of an object; and an operation sensor configured to be operatively connected to the controller and to detect movement of a door, and wherein the controller is configured to send a operation signal to the door motor to cause the door motor to operate when the controller detects both: a signal from the object sensor indicating that the operation sensor has detected the presence of and object; and a signal from the operation sensor indicating that the operation sensor has detected movement.

In another aspect, the disclosure describes a door system. The door system includes: a revolving door; a controller for controlling the door; a door motor operatively connected to the controller; an object sensor operatively connected to the controller and configured to detect a presence of an object; and an operation sensor operatively connected to the controller and configured to detect movement of a door, and wherein the controller is configured to send an operation signal to the door motor to cause the door motor to operate when the controller detects both: a signal from the object sensor indicating that the operation sensor has detected the presence of and object; and a signal from the operation sensor indicating that the operation sensor has detected movement.

In yet another aspect, the disclosure describes a method of controlling a revolving door. The method includes: providing a controller; configuring a door motor to be operatively connected to the controller; operatively connecting an object sensor to the controller and to detect a presence of an object; configuring an operation sensor to be operatively connected to the controller and to detect movement of a door, and configuring the controller to send an operation signal to the door motor to cause the door motor to operate when the controller detects both: a signal from the object sensor indicating that the operation sensor has detected the presence of and object; and a signal from the operation sensor indicating that the operation sensor has detected movement.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Additional features, advantages, and aspects of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate aspects of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION

Figure 1:
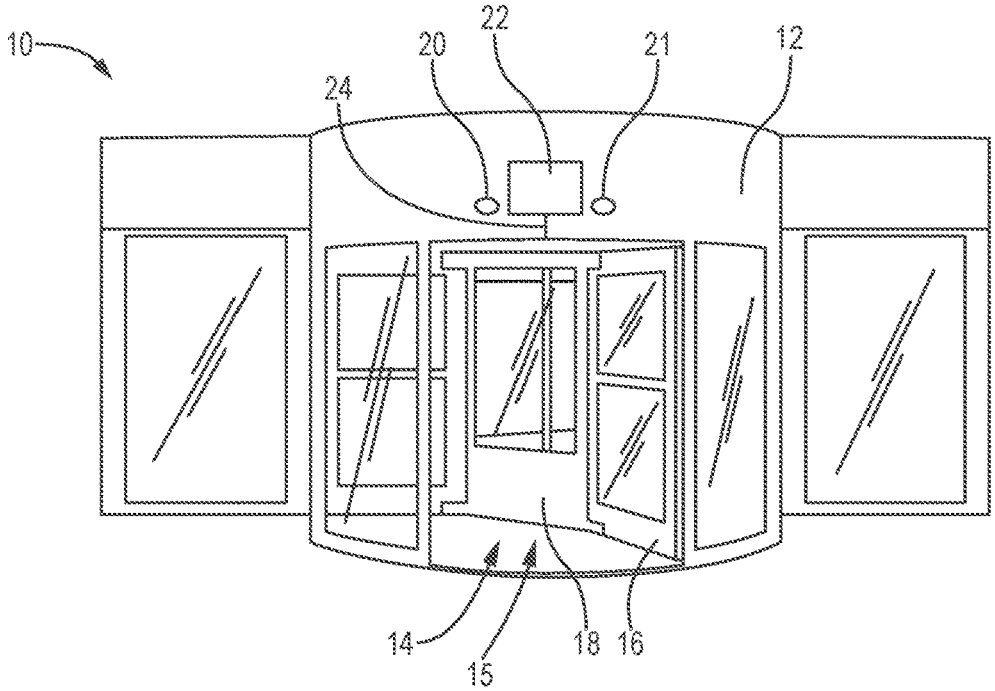
FIG. 1 is a perspective view of a revolving door system in accordance with the present disclosure.

The aspects of the disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the disclosure. The examples used herein are intended merely to facilitate an understanding of ways in which the disclosure may be practiced and to further enable those of skill in the art to practice the aspects of the disclosure. Accordingly, the examples and aspects herein should not be construed as limiting the scope of the disclosure, which is defined solely by the appended claims and applicable law. Moreover, it is noted that like reference numerals represent similar parts throughout the several views of the drawings.

FIG. 1 shows a door system 10 in accordance with the present disclosure. The door system 10 includes a door frame 12. An entrance way 14 is located adjacent to the door frame 12. It will be appreciated that another entrance way 14 is also located on the opposite side of the door frame 12. The door frame 12 provides a structure for the door 15. The door 15 has wings 16 and may optionally have a center portion 18. When equipped with a center portion 18 the wings 16 (often 2-4 but other amounts may also be used) attach to the center portion 18. When a door 15 has no center portion the wings 16 may attach to each other as is known in the art.

In accordance with the present disclosure, one or more object sensors 20 (and optionally 21) are oriented to detect the presence of an object in entrance way 14. In some embodiments the object sensor(s) 20 and/or 21 are mounted to the door frame 12 or the door wing 16. The door 15 is also operatively connected to a door motor 22. The motor 22 is configured to rotate the door 15 about a rotational axis 24.

Figure 2:
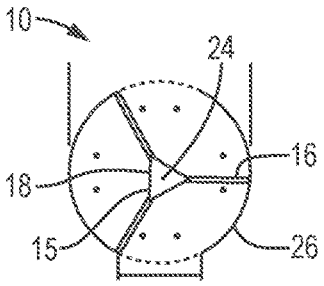
FIG. 2 is a top view of a revolving door that may be used in accordance with the present disclosure.
Figure 3:
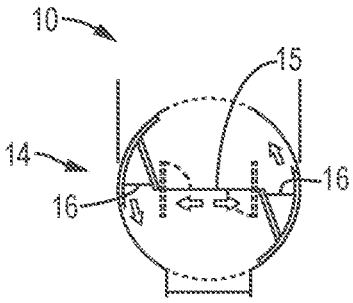
FIG. 3 is a top view of a revolving door that may be used in accordance with the present disclosure
Figure 4:
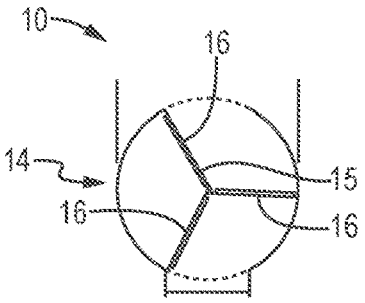
FIG. 4 is a top view of a revolving door that may be used in accordance with the present disclosure.

FIGS. 2, 3 and 4 are partial top views of door assemblies 10 have various example (but not limiting) door 15 configurations. FIG. 2 shows a door 15 having a center portion 18 and three wings 16. The door 16 is contained by a door drum 26 which provides sides and defines entrances/exits to the door assembly 10.

FIG. 3 shows a door 15 having two wings 16. The door 16 is contained by a door drum 26 which provides sides and defines entrances/exits to the door assembly 10.

FIG. 4 shows a door 15 having three wings 16. The door 16 is contained by a door drum 26 which provides sides and defines entrances/exits to the door assembly 10.

Figure 5:
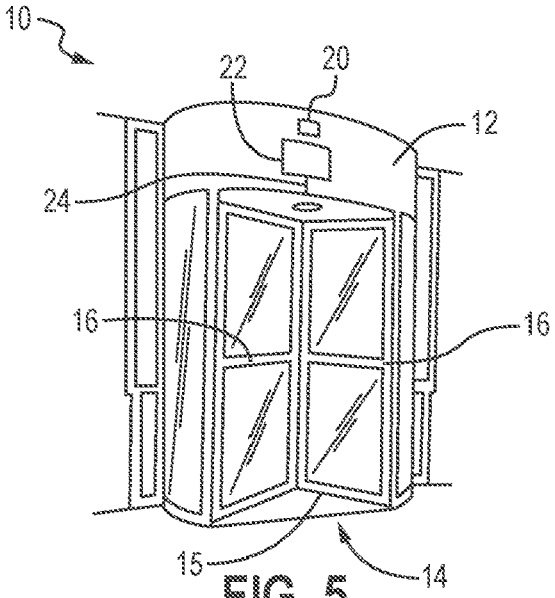
FIG. 5 is a perspective view of a revolving door system in accordance with the present disclosure.

FIG. 5 is a perspective view of a door system 10. The door motor 22 is located inside the door frame 12 but shown for illustrated purposes. In alternative embodiments, the door motor 22 could be mounted in floor under the door 15 or any other suitable place. The door motor 22 is operatively connected to the door 15 to cause the door 15 rotate about the door axis 24. The door 15 has 4 wings 16. A single object sensor 20 is mounted on the door frame 20 and configured to detect the presence of an object in the entrance way 14.

If the object sensor 20 or 21 senses an object in the entrance way 14 it may be interpreted that a person is in the entrance way 14 and presumably that person wants to move through the door system 10. When the pressure sensor 30 detects a pressure on the door 15, it may be interpreted as a person pushing on the door 15. However, pressure sensors 30, 31 alone are not dispositive as to whether a person is pushing on the door 15, because other forces such as wind acting on the door may activate the pressure sensors 30 and 31.

One of ordinary skill in the art after reviewing this disclosure will understand how to orient object sensor(s) 20 or 21 to detect whether a person is attempting to enter the door system 10. Further, one of ordinary skill in the art after reviewing this disclosure will understand how to locate and set the pressure sensor(s) 31 (and/or 32) to achieve a desired door system 10 performance. For example, in some embodiments, a threshold of how much force on the door 15 may be identified and set in order to trip (or activate) the pressure sensor(s) 30 (and/or 32).

In some embodiments, the sensitivity and area to monitor of the object sensor(s) 30 (and/or 32) may also identified and set to achieve a desired performance. Desired performance may also be a factor in selecting an amount of sensors 20, 21, 30, 32.

While the object sensor(s) 20 (21) is shown in the FIGS. to be mounted to the door frame 12 it will be understood that the object sensor(s) 20 (and/or 21) can be mounted to other structure such as the door drum 26, side structures of the door assembly 10 or any other suitable location where the object sensors (s) 20 (and/or 21) can detect the presence of an object in the entrance way 14.

Figure 6:
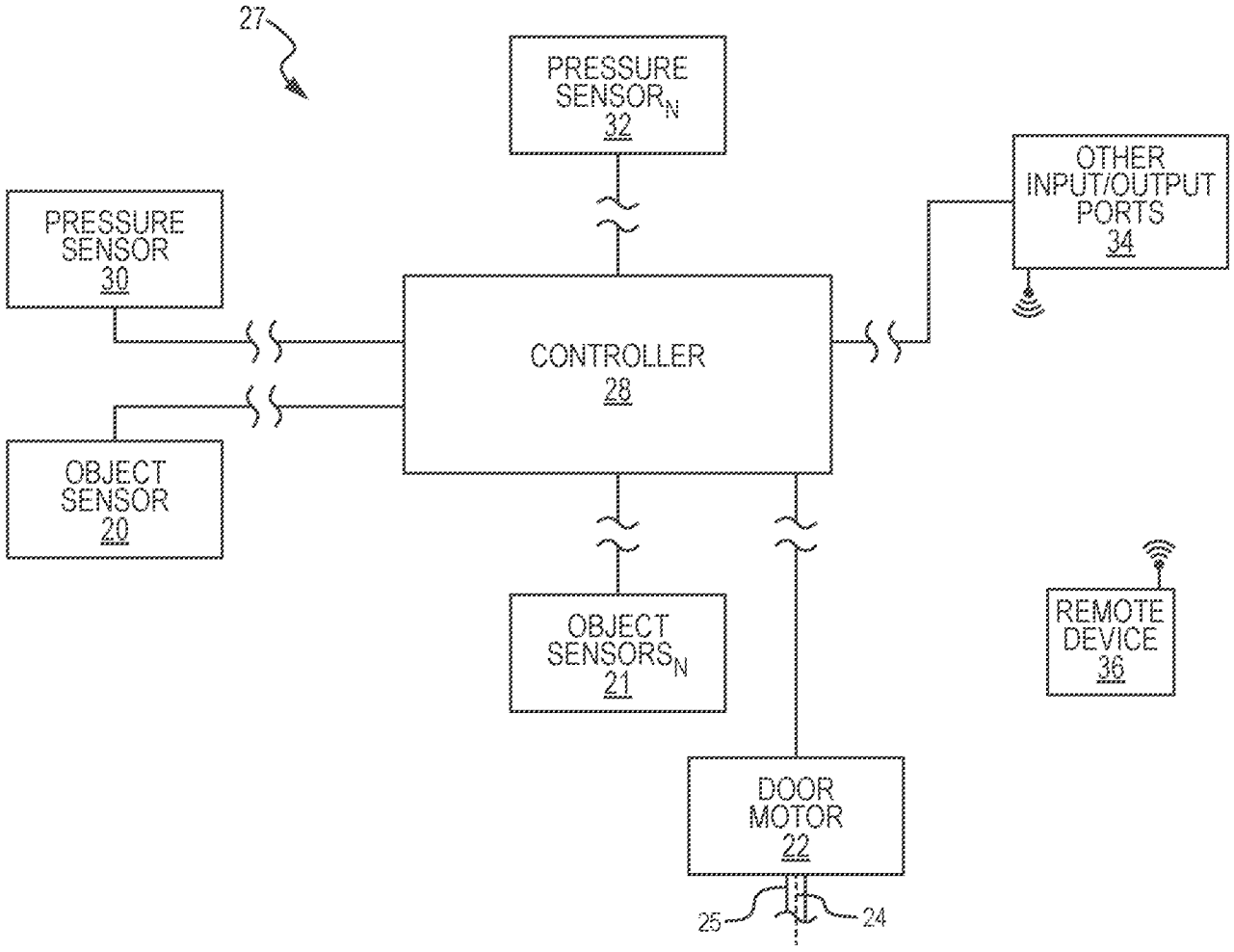
FIG. 6 is a schematic diagram of a door system in accordance with the present disclosure.

FIG. 6 is a schematic diagram of a control system for a door system 10 in accordance with the present disclosure. The control system 27 includes a controller 28. The controller 28 may be a microcontroller or any other suitable electronic controller. Controllers are known in the art and will not be explained in further detail.

The controller 28 has several inputs. For example, the controller 28, is operatively connected to and receives an input from the pressure sensor 30. Optionally additional pressure sensors 32 (indicated with a character "N" to denote that any number of additional pressures sensors may be used) may be operatively connected to the controller 28.

The controller 28, is operatively connected to and receives an input from the object sensor 20. Optionally, additional object sensors 20 (indicated with a character "N" to denote that any number of additional object sensors may be used) may be operatively connected to the controller 28.

The controller 28 is operatively connected to the door motor 22. The controller 28 is programed and configured to send operation signals to the door motor 22 based on the inputs. For example, if the controller 28 receives signals from one or more pressure sensors 30, 32 indicating that a force is action upon the door 15 and receives a signal from one or more of the object sensors 20, 21 indicating that an object is sensed in the entrance way 14 the controller 28 will send a signal to the door motor 22 to move the door shaft 25 to rotate the door 15 about the door axis 24. In some embodiments, the controller 28 may be programed to send an operation signal to the door motor 22 to operate the door 15 if anyone and/or combination of sensors 20, 21, 30, 32 are activated. One of ordinary skill in the art after reviewing this disclosure will know how to configure the door system 10 to operate based on what sensors 20, 21, 30 and 32 in order to achieve desired results for a particular installation.

In some embodiments in accordance with the disclosure, other inputs and/or outputs 34 may be operatively connected to the controller 28. For example, floor sensors, heat sensors, optical beams, or other sensors or other inputs may be operatively connected to the controller 28. Other outputs such as but not limited to a data base, a remote monitoring device, a remote maintenance service, a remote monitoring service such as a private or government security agency, an alarm system or other outputs may be connected to the controller 28.

In some embodiments, a remote device 36 may be operatively connected to the controller 28. The connection may be wired or wireless as shown in FIG. 6. The remote device may be, for example (but not limited to), a data base, a remote monitoring device, a remote maintenance service, a remote monitoring service such as a private or government security agency, an alarm system or other outputs may be connected to the controller 28 as mentioned above.

While the disclosure has been described in terms of exemplary aspects, those skilled in the art will recognize that the disclosure can be practiced with modifications in the spirit and scope of the appended claims. These examples given above are merely illustrative and are not meant to be an exhaustive list of all possible designs, aspects, applications or modifications of the disclosure.

I claim:

1. A control system for a door comprising:
- a controller;
- a door motor configured to be operatively connected to the controller;
- a first object sensor configured to be operatively connected to the controller and to detect a presence of an object; and
- an operation sensor configured to be operatively connected to the controller and to detect movement of the door, and
- wherein the controller is configured to send an operation signal to the door motor to cause the door motor to operate in response to the controller receiving both:
  - a signal from the first object sensor indicating that the first object sensor has detected the presence of the object; and
  - a signal from the operation sensor indicating that the operation sensor has detected the movement.

2. The control system of claim 1, further comprising at least one second object sensor configured to be operatively connected to the controller and to detect the presence of the object, wherein the controller is further configured to send the operation signal to the door motor to cause the door motor to operate when the controller detects both:
- a signal from at least one of the at least one second object sensor indicating that the at least one second object sensor has detected the presence of the object; and
- the signal from the operation sensor indicating that the operation sensor has detected the movement.

3. The control system of claim 1, wherein the operation sensor includes any one of a torque sensor, a motor current sensor, a motor movement sensor, or a sensor that is configured to detect rotational movement.

4. The control system of claim 1, wherein the operation sensor is configured to sense movements associated with the door.

5. The control system of claim 1, further comprising a revolving door and the door motor is operatively connected to the door.

6. The control system of claim 5, wherein the first object sensor is mounted in a door frame.

7. The control system of claim 1, wherein the first object sensor is configured to detect the presence of the object in an entranceway of a door system.

8. The control system of claim 1, wherein the controller is configured to:
- receive a plurality of inputs, the plurality of inputs comprising the signal from the object sensor, the signal from the operation sensor, and at least one additional input; and
- send a plurality of outputs, the plurality of outputs comprising the operation signal and at least one additional output.

9. The control system of claim 1, wherein the controller is configured to control at least one of either lights associated with a door system or a locking system associated with the door.

10. The control system of claim 1, wherein the controller is configured to receive inputs from a remote device.

11. A door system comprising:
- a revolving door;
- a controller for controlling the door;
- a door motor operatively connected to the controller;
- a first object sensor operatively connected to the controller and configured to detect a presence of an object; and
- an operation sensor operatively connected to the controller and configured to detect movement of the door, and
- wherein the controller is configured to send an operation signal to the door motor to cause the door motor to operate in response to the controller receiving both:
  - a signal from the first object sensor indicating that the first object sensor has detected the presence of the object; and
  - a signal from the operation sensor indicating that the operation sensor has detected the movement.

12. The door system of claim 11, further comprising a second object sensor operatively connected to the controller and configured to detect the presence of the object, wherein the controller is configured to send the operation signal to the door motor to cause the door motor to operate when the controller detects both:
- a signal from the second object sensor indicating that the second object sensor has detected the presence of the object; and
- a signal from the operation sensor indicating that the operation sensor has detected the movement.

13. The door system of claim 11, wherein the operation sensor is a torque sensor that is configured to detect rotational movement of a shaft operatively connected to the door.

14. The door system of claim 11, wherein the operation sensor is configured to sense movements associated with the door.

15. A method of controlling a revolving door comprising:
- providing a controller;
- configuring a door motor to be operatively connected to the controller;
- operatively connecting a first object sensor to the controller and to detect a presence of an object;

configuring an operation sensor to be operatively connected to the controller and to detect movement of the door, and configuring the controller to send an operation signal to the door motor to cause the door motor to operate in response to the controller receiving both:

a signal from the first object sensor indicating that the first object sensor has detected the presence of the object; and a signal from the operation sensor indicating that the operation sensor has detected the movement.

16. The method of claim 15, further comprising:

configuring at least one second object sensor to be operatively connected to the controller and to detect the presence of the object; and configuring the controller to send the operation signal to the door motor to cause the door motor to operate when the controller detects both:

a signal from any one of the at least one second object sensor indicating that the one of the at least one second object sensor has detected the presence of the object; and a signal from the operation sensor indicating that the operation sensor has detected movement.

17. The method of claim 15, further comprising configuring the operation sensor to sense movements associated with the door.

18. The method of claim 15, further comprising mounting the first object sensor to a door frame.

19. The method of claim 15, further comprising configuring the first object sensor to detect the presence of the object in an entranceway of a door system.

20. The method of claim 15, operatively connecting the door motor to the revolving door.

* * * * *